United States Patent [19]

Fujiwara et al.

[11] Patent Number: 5,074,478

[45] Date of Patent: Dec. 24, 1991

[54] SYSTEM FOR CRUSHING AND DISCHARGING POWDER AND GRANULAR MATERIAL CAKING IN STORAGE TANK

[75] Inventors: Seiichi Fujiwara; Kohji Anao, both of Chiba; Mutsuo Kubo; Ryuichi Miyagawa, both of Tokyo, all of Japan

[73] Assignee: Shimizu Construction Co., Ltd., Tokyo, Japan

[21] Appl. No.: 580,037

[22] Filed: Sep. 10, 1990

[30] Foreign Application Priority Data

Nov. 10, 1989 [JP] Japan ..... 1-293246

[51] Int. Cl.[5] ..... B02C 19/00

[52] U.S. Cl. ..... 241/60; 241/101.1; 241/283

[58] Field of Search ..... 241/101.1, 101.2, 101.4, 241/101.7, 57, 283, 60; 414/304, 305, 324; 222/200, 409, 278

[56] References Cited

U.S. PATENT DOCUMENTS

| | | | |
|---|---|---|---|
| 1,138,627 | 5/1915 | Considine | 241/283 X |
| 1,291,895 | 1/1919 | Howlett | 241/283 |
| 2,187,587 | 1/1940 | Kehl | 241/283 X |
| 4,313,706 | 2/1982 | Danford | 241/283 X |

OTHER PUBLICATIONS

"A Review of Hopper Discharge Aids", by A. R. Reed and C. H. Duffell, Bulk Solids Handling, The International Journal of Storing and Handling Bulk Materials, vol. 3, No. 1, Mar. 1983.

"Gem Europoort Terminal (Only Six Years Old), Again Engaged in Major Expansion Programme", Technology/Economics, Rotterdam Euroopoort Delta, pp. 33–35, Article by Hans Berggren.

*Primary Examiner*—Mark Rosenbaum

*Attorney, Agent, or Firm*—Armstrong, Nikaido, Marmelstein, Kubovcik & Murray

[57] ABSTRACT

A system for crushing and discharging a powder and granular material that has become caked in a storage tank has a device for supplying compressed air that is used to activate machines as well as to blow up and deliver crushed material, a drilling machine which has drilling rotary blades that rotate at the distal end of a casing to drill a guide hole in the caked material for discharging crushed material by applying impact and rotation to the rotary blades by means of compressed air, and a crusher which has crushing blades to cut the opening edge of the drilled guide hole and to crush the periphery of the guide hole. A guide hole for discharging crushed grain is drilled in the caked grain by applying impact and rotation to the rotary blades of the drilling machine by use of compressed air, and after the guide hole has been drilled, crushing is carried out with the crusher. Since not electricity but compressed air is employed, it is possible to eliminate the fear of a spark being generated. In addition, the caked grain can be crushed and discharged through the guide hole by gravity flow without the necessity for an operator to enter the silo.

7 Claims, 5 Drawing Sheets

SYSTEM FOR CRUSHING AND DISCHARGING POWDER AND GRANULAR MATERIAL CAKING IN STORAGE TANK

BACKGROUND OF THE INVENTION

The present invention relates to a system for crushing and discharging a powder and granular material that has become caked in a silo and incapable of being discharged by gravity flow.

Among tanks for storing powder and granular materials, grain silos are generally formed from concrete or iron plates. For example, an iron plate silo that has an inner diameter of 10 m and a height of 38 m can store up to 1,800 tons of grain.

With a view to storing grain in a stable state, it is desirable to lower the temperature and humidity in the silo. However, since no equipment for such purpose is available in general, it is a common practice to move the grain in the silo in quantities properly determined according to experiences, thereby preventing the grain from caking in the silo. In this case, however, the grain may cake if the interval of time at which the grain is moved is not properly determined and careful consideration is not given to the grain size of the grain and the amounts of water and oil retained therein.

It is known that grain causes a rise in the temperature thereof by its own respiration and the multiplication of microbes and this may invite an exothermic accident. The rise in the temperature of the grain also leads to caking. In addition, since grain is combustible and contains a large amount of dust, it involves the danger of dust explosion and must be kept out of fire and sparks. Since grain is a food material, it must also be kept out of any contaminative substance.

In general, grain that is to be stored in a silo is fed therein from the ceiling and discharged from an outlet in the bottom by gravity flow. If the grain has become caked in the silo, it cannot be discharged by gravity flow any longer and must be crushed in order to feed it out of the silo.

For this purpose, a manhole of about 600 mm is generally provided in the ceiling of the silo. When the grain in the silo has become caked and needs crushing, a crushing operation is conducted by use of the manhole. In the crushing operation, a boring machine is first installed on the rooftop of the silo, and then a rod is lowered through the manhole to bore a through-hole for discharge which extends from the top of the caked grain to the lowermost end. Thereafter, a special wire is passed through the hole to enlarge it, and then an operator goes down onto the caked grain and cuts it successively from the periphery of the through-hole with a coal pick hammer or other similar tool, thereby crushing and discharging the caked grain.

However, since the strength of the ceiling of the silo is limited and no lifting equipment is available, it is impossible to install a large-sized machine on the rooftop of the silo. For this reason, it is only possible to adopt a boring machine or the like, which is classified as a relatively small-sized machine. In some cases, there is a shed above the rooftop of the silo and the crushing operation must be carried out inside the shed. In such cases, since the building is not sufficiently high and a large number of installations, for example, conveyor and piping, are disposed on the rooftop of the silo, even the space required for scaffolding cannot be ensured satisfactorily and it is also difficult to bring a boring machine onto the rooftop of the silo and move it there sidewardly.

In addition, the diameter of the hole that is drilled by the boring machine is so small that the hole needs to be enlarged by means of a special wire. Since the hole is likely to curve, the silo wall may be damaged and there is another problem that the grain may be burned by the frictional heat that is generated between the machine cutter and the silo wall.

Further, since the operator must enter the silo through the manhole provided in the ceiling and crush the caked grain by a manual operation, the burden on the operator is considerably heavy and the working environment is bad. More specifically, a silo that is stored with grain may be short of oxygen, and since the operator must enter the silo through a manhole provided in the ceiling that is as high as 35 m, various problems arise from the viewpoint of safety.

As has been stated above, the cake crushing operation in the silo involves fears that the inside of the silo may be short of oxygen, that the operator may slip and fall during the crushing operation, that the operator may be buried alive in the grain collapsed, that a fire may start in the silo by an unexpected accident, and that a cardiopulmonary disorder may be caused by the dust resulting from the crushing of the caked grain. It is therefore necessary to take a measure to prevent the operator from slipping down, instruct the operator to wear a dust-proof mask, and effect ventilation. In addition, since the crushing operation is carried out by human power, the operating efficiency is low, and if the operation procedure is carried out inappropriately, the caked grain may collapse in the form of a huge heap and destroy the substructure of the silo.

SUMMARY OF THE INVENTION

It is an object of the present invention to enable the caked grain to be crushed and discharged without the necessity for an operator to enter the silo.

It is another object of the present invention to provide a system for crushing and discharging a powder and granular material caking in a storage tank, which is designed so that the safety is improved and the operating efficiency is increased.

To these ends, the present invention provides a system for crushing and discharging a powder and granular material that has become caked in a storage tank, which comprises a device for supplying compressed air that is used to activate machines and to blow up and deliver crushed material, a drilling machine which has drilling rotary blades that rotate at the distal end of a casing to drill a guide hole in the caked material for discharging crushed material by applying impact and rotation to the rotary blades by means of compressed air, and a crusher which has crushing blades to cut the opening edge of the drilled guide hole and to crush the periphery of the guide hole.

By virtue of the above-described arrangement, a guide hole for discharging crushed grain is drilled in the caked grain by applying impact and rotation to the rotary blades of the drilling machine by use of compressed air, and it is therefore possible to increase the crushing efficiency and reduce the weight of the machine. Since no electricity is employed as a power source, a guide hole can be drilled without inviting a fire nor spark. Since crushing is carried out by the crusher after the guide hole has been drilled, the caked grain can be crushed and discharged through the guide hole by gravity flow without the necessity for an operator to enter the silo.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

DESCRIPTION OF PREFERRED EMBODIMENTS

One embodiment of the present invention will be described below with reference to the accompanying drawings.

Figure 1A:
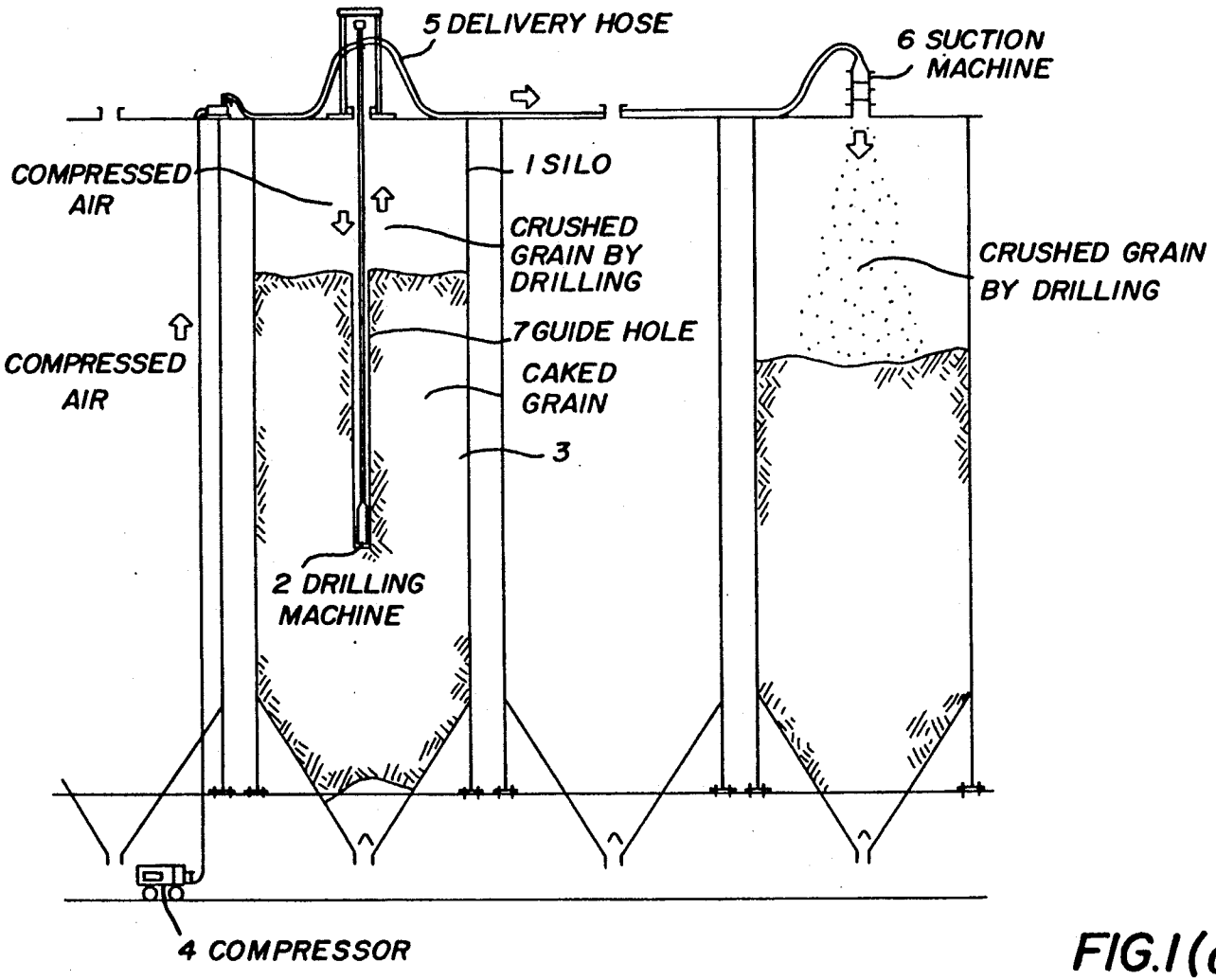
FIGS. 1(*a*) and 1(*b*) show one embodiment of a system for crushing and discharging grain caking in a silo according to the present invention.
Figure 1B:
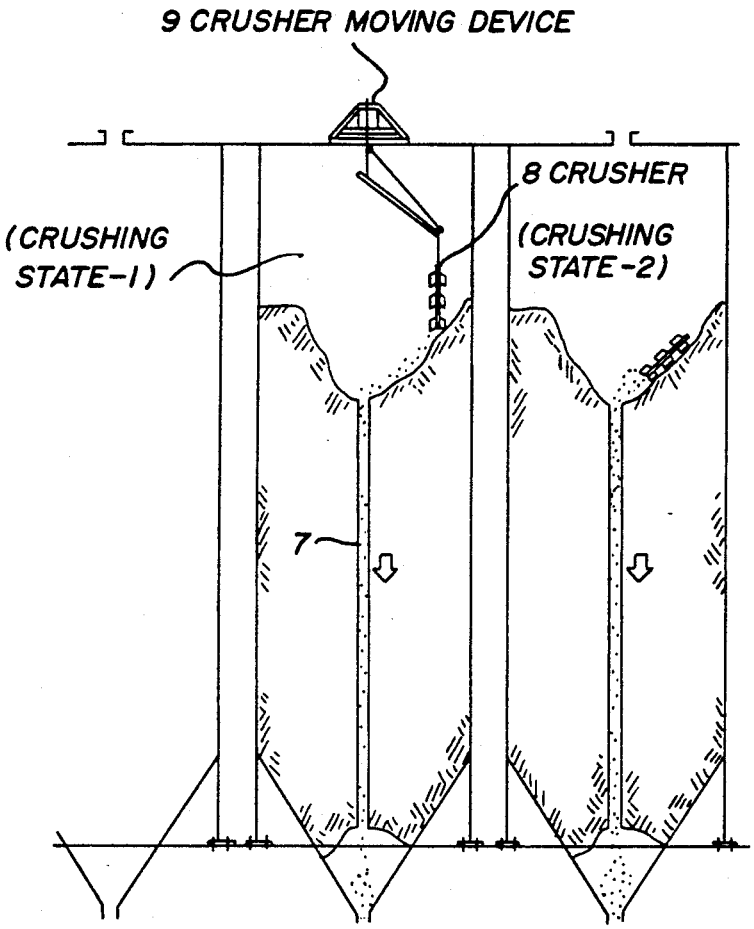

Referring first to FIGS. 1(*a*) and 1(*b*), reference numeral 1 denotes a silo, 2 a drilling machine, 3 caked grain, 4 a compressor, 5 a delivery hose, 6 a suction machine, 7 a guide hole, 8 a crusher, and 9 a crusher moving device.

The system for crushing and discharging grain caking in a silo according to the present invention is arranged such that a guide hole 7, which is an opening for discharging the caked grain 3, is first drilled by the drilling machine 2, as shown in FIG. 1(*a*), and then the caked grain 3 is crushed by the crusher 8 and the crushed grain is discharged through the guide hole 7, as shown in FIG. 1(*b*). In other words, the caked grain crushing and discharging system according to the present invention uses the drilling machine 2 and the crusher 8 to crush the caked grain and discharge the crushed grain. As a power source, not electricity but the compressed air that is obtained from the compressor 4 is employed to activate both the drilling machine 2 and the crusher 8 and also to deliver grain, which is crushed when the guide hole 7 is drilled in the caked grain, to the outside of the silo.

The drilling machine 2 is arranged to rotate drilling rotary blades while applying a light impact thereto, thereby minimizing the weight of the machine and increasing the cutting efficiency. The crusher 8 is a vibratory cutting machine that incorporates a vibrating mechanism. The crusher 8 is moved within the silo 1, as shown by State-1 and State-2 in FIG. 1(*b*), by the crusher moving device 9 that employs a wire and a simple boom, thereby enabling crushing to be effected over a wide range.

The drilling machine and the crusher will next be explained.

Figure 2:
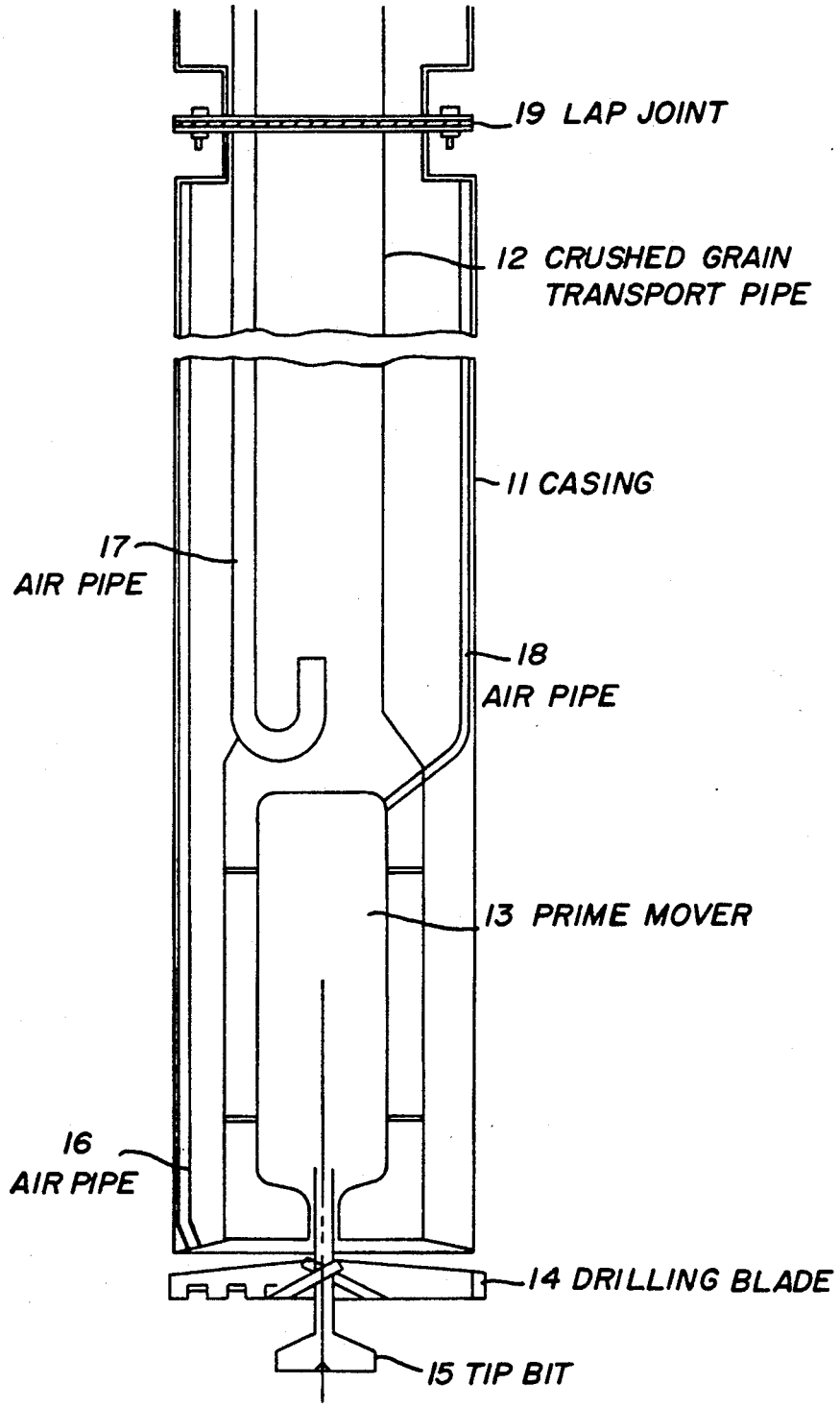
FIGS. 2(*a*)–2(*d*) respectively show a sectional structure of a drilling machine which is employed in the embodiment and schematic end views of a lap joint, drilling blade, and tip bit thereof.
Figure 2B:
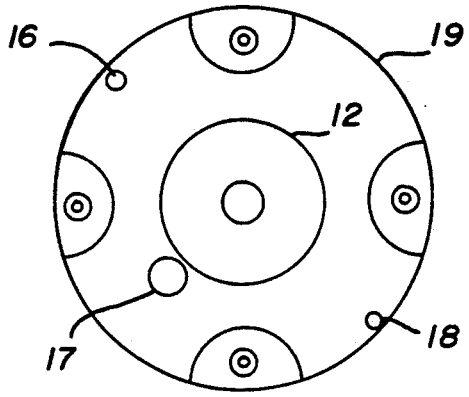
Figure 2C:
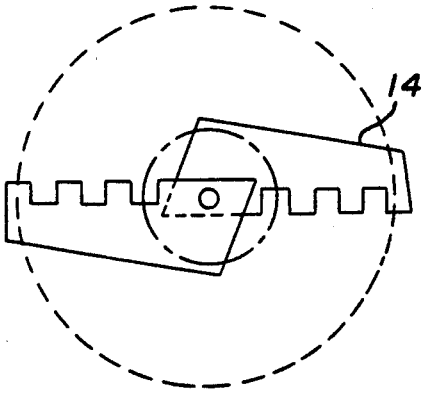
Figure 2D:
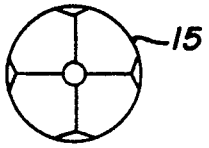

Referring to FIGS. 2(*a*)–2(*d*) reference numeral 11 denotes a casing, 12 a crushed grain transport pipe, 13 a prime mover, 14 drilling rotary blades, 15 a tip bit, 16 to 18 air pipes, and 19 a lap joint.

As shown in FIG. 2(*a*), the drilling machine has the tip bit 15 and the drilling rotary blades 14, which are attached to the distal end of the casing 11, and further has the prime mover 13 at the upper side of the rotary blades 14 as viewed in FIG. 2(*a*) and the crushed grain transport pipe 12 that extends through the center of the casing 11 and communicates with the outside of the silo. The prime mover 13 rotates the tip bit 15 and the rotary blades 14 while applying vibration thereto, thereby drilling the guide hole 7 and discharging the crushed grain to the outside of the silo through the transport pipe 12 that extends through the center of the guide hole 7. Thus, the tip bit 15 is adapted to drill a so-called pilot hole so that the guide hole 7 can be drilled straight without being curved, and the rotary blades 14 drill the guide hole 17 along the pilot hole. In this way, the diameter of the drilled hole can be enlarged efficiently. The air pipe 16 extends as far as a position which is directly above the rotary blades 14 provided at the distal end of the casing 11 to supply compressed air to entrain grain that is crushed by the tip bit 15 and the rotary blades 14. The air pipe 17 is bent 180° above the prime mover 13 so that the outlet faces upward, to supply compressed air for delivering the crushed grain to the outside of the silo through the transport pipe 12. The air pipe 18 supplies compressed air for activating the prime mover 13. Thus, the crushed grain that results from the drilling of the guide hole 7 by the tip bit 15 and the rotary blades 14 is blown in an upward direction by the compressed air that is supplied through the air pipe 16 and then delivered by the compressed air that is supplied through the air pipe 17. The lap joint 19 is designed so that the flange diameter is the same as the diameter of the sleeved pipe with a view to minimizing the resistance of the pipe. FIG. 2(*b*) is a plan view of the lap joint 19; FIG. 2(*c*) is a plan view of the drilling rotary blades 14; and FIG. 2(*d*) is a plan view of the tip bit 15. Although the rotary blades 14 shown in FIG. 2(*c*) comprise two blades, the number of blades may be three or more.

The crusher will next be explained.

Figure 3A:
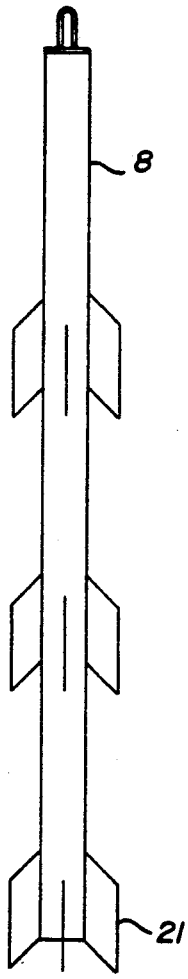
FIGS. 3(*a*) and 3(*b*) respectively are side and end views of a crusher which is employed in the embodiment; and ·
Figure 3B:
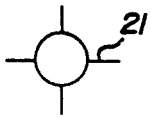
Figure 4C:
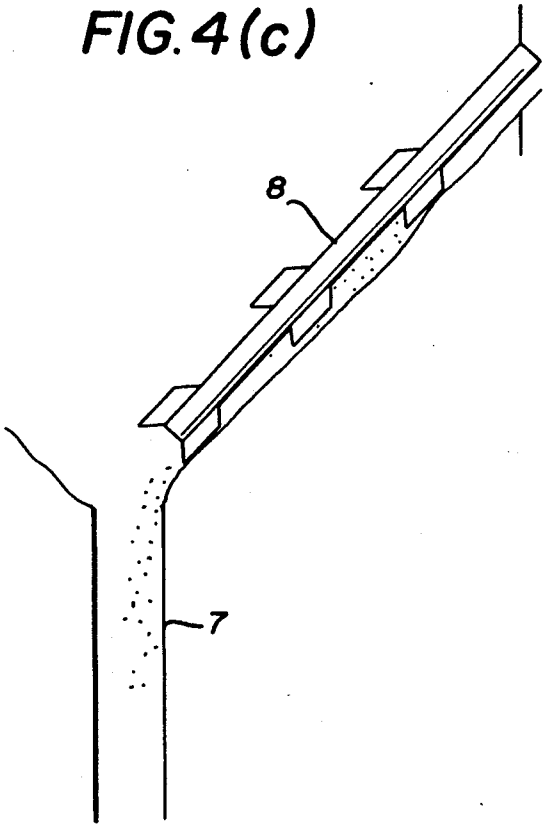
FIGS. 4(*a*)–4(*c*) sequentially show a crushing operation that is carried out with the crusher.
Figure 4B:
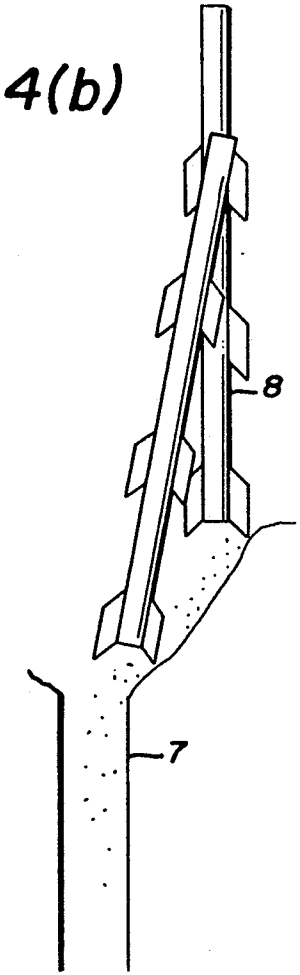
Figure 4A:
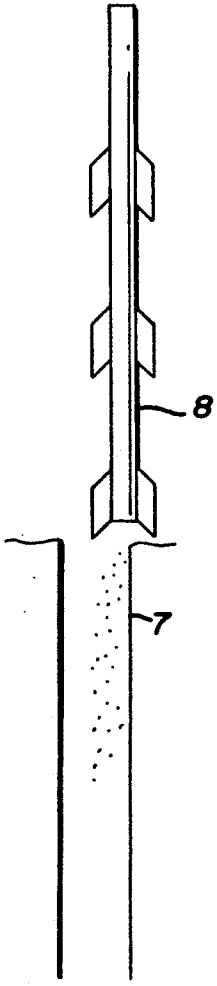

The crusher has crushing blades 21 in a multi-stage rocket-like form, as shown in FIG. 3(*a*) and 3(*b*), and incorporates a transverse vibration mechanism that vibrates in response to the supply of compressed air. The crusher replaces the drilling machine upon completion of the drilling of a guide hole by the drilling machine. First, edge cutting is carried out with the crushing blades 21 provided at the distal end of the crusher, thereby dropping crushed grain through the guide hole 7, as shown in FIG. 4(*a*). Upon completion of the edge cutting operation, the periphery of the opening of the guide hole 7 is crushed, as shown in FIG. 4(*b*), and the crushing operation is then progressed using all the crushing blades 21 with the crusher being slid so that the opening of the guide hole 7 is cut into a conical shape, as shown in FIG. 4(*c*). This operation is conducted by use of the crusher moving device 9, as shown in FIG. 1(*b*).

It should be noted that the present invention is not necessarily limitative to the above-described embodiment and that various changes and modifications may be imparted thereto. For example, although in the foregoing embodiment the present invention is applied to a grain silo, it is similarly applicable to tanks for storing powder and granular materials other than grain, which are likely to cake during storage. Although the drilling machine in the foregoing embodiment employs two discrete air pipes to supply compressed air for blowing up crushed grain and transporting it, the arrangement may be such that crushed grain is introduced into the casing by means of a single air pipe that functions as both the two air pipes. In addition, although the crushed grain transport pipe extends through the center of the casing, the arrangement may be such that the air pipes are laid in the center of the casing and the space that is defined between the periphery of the air pipes and the inner wall of the casing is utilized as a crushed grain transport duct. In a case where a hole with a sufficiently large diameter can be formed only with the drilling rotary blades, the tip bit of the drilling machine may be omitted. It is also possible to arrange the drilling machine such that no impact is applied to the rotary blades according to the degree to which the grain has become caked.

As will be clear from the foregoing description, it is possible according to the present invention to crush and discharge the caked grain without the necessity for an operator to enter the silo and hence possible to improve the safety in the crushing operation. Since no electricity is used as a power source but compressed air is employed to drive both the drilling machine and the crusher, it is possible to avoid the generation of sparks and prevent a rise in the temperature inside the silo due to the generation of heat. In addition, since the crushing operation is effected by means of the vibration and rotational drive caused by compressed air, the crushing efficiency is high and it is possible to reduce the size and weight of the machine. Accordingly, it is possible to perform a crushing operation with ease by actuating the machine using the conventional manhole without the need to change the structure of the silo.

What we claim is:

1. A system for crushing and discharging a powder and granular material that has become caked in a storage tank, comprising:

means for drilling a guide hole in the caked material for discharging crushed material;

means for cutting an opening edge of said guide hole and crushing the periphery of said guide hole with a crushing blade; and means for supplying compressed air to activate both said drilling means and said cutting means as well as to entrain and deliver the crushed material.

2. A system according to claim 1, wherein said drilling means has a casing and a drilling rotary blade that rotates at the distal end of said casing.

3. A system according to claim 2, wherein said drilling rotary blades of said drilling means are caused to move by impact in rotation.

4. A system according to claim 3, wherein said drilling means has a tip bit for drilling a pilot hole, which is provided forwardly of said rotary blade.

5. A system according to claim 2, wherein said drilling means has a crushed material transport pipe which is provided within said casing to entrain and deliver said material crushed by said drilling rotary blade to the outside of said storage tank.

6. A system according to claim 5, wherein said drilling means has a prime mover which is provided within said casing and which is driven by said compressed air, a first air pipe for supplying said compressed air to said prime mover, and a second air pipe for supplying compressed air that blows off into said crushed material transport pipe upwardly from the vicinity of said drilling rotary blade.

7. A system according to claim 1, wherein said crushing means is a vibratory crusher that crushes the periphery of said guide hole with said crushing blade vibrated while it is moved by a moving device.

* * * * *